US011664922B2

(12) United States Patent
Pang et al.

(10) Patent No.: US 11,664,922 B2
(45) Date of Patent: May 30, 2023

(54) RADIO-BASED DETECTOR AND METHOD TO PROTECT AGAINST UNPREDICTABLE INTERFERENCE IN INDUSTRIAL WIRELESS COMMUNICATIONS

(71) Applicant: Hitachi Energy Switzerland AG, Baden (CH)

(72) Inventors: Zhibo Pang, Vasteras (SE); Michele Luvisotto, Vasteras (SE); Roger Jansson, Vasteras (SE)

(73) Assignee: Hitachi Energy Switzerland AG, Baden (CH)

( * ) Notice: Subject to any disclaimer, the term of this patent is extended or adjusted under 35 U.S.C. 154(b) by 0 days.

(21) Appl. No.: 17/428,315

(22) PCT Filed: Feb. 4, 2020

(86) PCT No.: PCT/EP2020/052771
§ 371 (c)(1),
(2) Date: Aug. 4, 2021

(87) PCT Pub. No.: WO2020/164977
PCT Pub. Date: Aug. 20, 2020

(65) Prior Publication Data

US 2022/0131634 A1 Apr. 28, 2022

(30) Foreign Application Priority Data

Feb. 13, 2019 (EP) ..... 19156813

(51) Int. Cl.
*H04K 3/00* (2006.01)

(52) U.S. Cl.
CPC ..... *H04K 3/226* (2013.01); *H04K 2203/18* (2013.01); *H04K 2203/36* (2013.01)

(58) Field of Classification Search
CPC ..... H04K 2203/18; H04K 2203/36; H04K 3/224; H04K 3/226
(Continued)

(56) References Cited

U.S. PATENT DOCUMENTS 5,699,045 A * 12/1997 Frederick ..... G08B 13/2488 340/572.4
5,722,061 A 2/1998 Hutchison, IV et al.
(Continued)

FOREIGN PATENT DOCUMENTS

EP 2993953 A1 3/2016
WO 2008/030446 A2 3/2008

OTHER PUBLICATIONS

Gummadi et al., Understanding and mitigating the impact of RF interference on 802.11 networks, Computer Communication Review, ACM, New York, NY, US, vol. 37, No. 4, Aug. 27, 2007, pp. 385-396, XP058203336, ISSN: 0146-4833, DOI: 10.1145/1282427.1282424 section 6.1, 12 pages.
(Continued)

*Primary Examiner* — Tan H Trinh
(74) *Attorney, Agent, or Firm* — Procopio Cory Hargreaves and Savitch LLP

(57) ABSTRACT

A method, a node and a detector for detecting an interfering signal in a wireless network communication system comprising a network manager and several nodes, each node (202B) comprising a detector (204) for receiving input signals from at least one antenna, a delay component (205) for delaying a received input signal, and a receiver (206RX) for determining an energy pattern of expected received input signals. The detector (204) is configured to send an alarm signal to the receiver (206RX) depending on the presence or absence of an interfering signal from an interferer 203 and an active/inactive state of the receiver (206RX).

16 Claims, 4 Drawing Sheets

(58) Field of Classification Search
USPC ..... 455/512; 375/150; 340/572.4, 870.02
See application file for complete search history.

(56) References Cited

U.S. PATENT DOCUMENTS

| | | | | |
|---|---|---|---|---|
| 7,577,181 | B2 * | 8/2009 | Cornwall | H04B 1/7156 340/870.02 |
| 10,084,565 | B1 | 9/2018 | Kim et al. | |
| 10,841,951 | B2 * | 11/2020 | Wang | H04W 74/0808 |
| 2004/0142670 | A1 | 7/2004 | Ciccarelli | |
| 2004/0224708 | A1 * | 11/2004 | Brabenac | H04W 16/14 455/512 |
| 2009/0268788 | A1 * | 10/2009 | Simic | H04K 3/224 375/150 |
| 2011/0053517 | A1 | 3/2011 | Wright et al. | |
| 2012/0273289 | A1 * | 11/2012 | Seymour | B60R 25/1025 180/287 |
| 2015/0293234 | A1 | 10/2015 | Snyder et al. | |
| 2016/0353293 | A1 * | 12/2016 | Tsai | H04L 27/2331 |
| 2017/0214563 | A1 * | 7/2017 | Gerdes | H04L 27/00 |
| 2021/0105631 | A1 * | 4/2021 | Green | H04W 16/14 |

OTHER PUBLICATIONS

International Search Report and Written Opinion of the International Searching Authority for related PCT application No. PCT/EP2020/052771 dated Feb. 20, 2020, 16 pages.

* cited by examiner

RADIO-BASED DETECTOR AND METHOD TO PROTECT AGAINST UNPREDICTABLE INTERFERENCE IN INDUSTRIAL WIRELESS COMMUNICATIONS

TECHNICAL FIELD

The present invention relates to the detection of external interference in industrial wireless networks.

BACKGROUND ART

Industrial communication systems are used in the automation of power system, for example sub-station automation or control of high-voltage converters. In order to enhance the flexibility and scalability as well as to reduce the costs, it is convenient to replace wired networks such as Ethernet-based networks with wireless networks.

One of the biggest concerns when introducing wireless networks in industrial control systems is related to the shared nature of the radio channel, which implies that if two or more devices transmit simultaneously on the same frequency band, their transmission will collide, likely preventing the target receivers to decode them correctly. For this reason, access to the channel in industrial wireless networks is tightly scheduled, for example using systems with time scheduling such as time-division multiple access (TDMA), so that no collisions between wireless entities/nodes in the same networks occur.

However, industrial wireless systems operating in license-free bands, e.g. the 2.4 GHz industrial, scientific and medical (ISM) band, are not only subject to intra-network interference, but might also suffer from external interference from other systems sharing the same spectrum. These systems typically have unpredictable transmission patterns and power levels with respect to the industrial network used for control and, hence, it can be very hard to protect from this kind of interference.

Moreover, there could also be cases in which one or more malicious transmitters emit radio signals with very high power in the same frequency band as the industrial network, thus jamming the wireless channel and possibly stopping the operations of the control system.

The issue of unpredictable disturbances, such as interference from an external network or malicious jamming, plagues any industrial wireless network deployed in license-free bands and is often seen as the biggest concern for the success of wireless solutions in the market. As a consequence, any industrial wireless solution needs to deploy some mechanisms to combat unpredictable interference.

The most common approach (used by e.g. WirelessHART) is to minimize the impact of this interference by adopting a frequency-hopping schedule, in which the transmitting and receiving nodes continuously switch the frequency channel according to a predetermined pattern. A more advanced mechanism is to combine frequency hopping and channel blacklisting, according to which the channels which are experiencing a strong external interference are excluded from the hopping schedule.

These mechanisms allow to improve the resilience to unpredictable interference on average, but still present some issues. For example, a malicious jammer could learn the frequency hopping schedule and adapt the jamming signal to it, thus impairing all the communication attempts.

SUMMARY OF THE INVENTION

The present disclosure intends to solve the above-mentioned problems by providing a wireless network node for detecting an interfering signal in a wireless network communication system before the interfered signal is received by the receiver. These problems are addressed by a method, wireless network node and detector with the technical features of the independent claims.

The wireless network node comprises a transmitter and a receiver configured to transmit/receive information to/from other nodes in the wireless network communication system, a detector configured to receive and process an input signal from at least one antenna, and a delay component configured to delay said input signal from said at least one antenna prior to arrival at said receiver. The receiver is further configured to determine an energy pattern of expected received input signals based on topology of the wireless network communication system and/or based on data traffic patterns. The network topology is the arrangement of the nodes linked to the wireless network and data traffic patterns are patterns of the amount of data or data packets moving across the network at a given point of time. The detector is further configured to receive and compare the energy pattern of expected received input signals with an energy pattern of the input signal from the at least one antenna and to emit an alarm signal to at least the receiver while the delay component is delaying said input signal's arrival at the receiver, in the event that said receiver is active and said input signal has an energy pattern different from said energy pattern of expected received input signals and/or in the event that said receiver is inactive and said input signal has an energy pattern similar or equal to said energy pattern of expected received input signals.

Further, in the event the receiver is active and upon receipt of the alarm signal, the receiver may be configured to change to a new (e.g., a different which may or may not have been previously utilized) channel to prevent the jammed signal from continuing to interfere with the received input signal.

In the event the receiver is active, so that the circuit of the node is closed, the detector of the network node may also be configured to send the alarm signal to the transmitter of the wireless network node. The alarm signal may then trigger the transmitter to send a message on a reserved channel to inform other network nodes wirelessly linked to the system of a detected interfering signal in the transmitted signal and may request a change of channel/frequency. The requested channel should be the same channel (new channel) to which the receiver changed in order to continue the communication on the same frequency.

The claimed wireless network node may comprise a switch arranged to disconnect the at least one antenna from a receiving processing circuit, in order, wherein the switch is configured to be opened if said receiver is active and or to be closed if said receiver is inactive whilst receiving the alarm signal from the detector. The switch is configured to allow disconnec-ting/connecting the baseband/receiver if an interference is detected/not detected and triggers automatic actions to handle that interference/lack of interference. Further, a delay component may be configured to delay the input signal from the at least one antenna prior to arrival at said receiver.

Further, in the event the receiver is active when an interference is detected and the alarm signal is sent to a switch to be opened, the receiver may be configured to change its underlying control system to safe mode after the switch is opened. The safe mode is a mode where the functionality of the underlying control system is reduced. The advantage of changing the underlying control system to safe mode is that a system in safe mode is better adapted to tolerate potential losses of data packets due to the low performance of the network.

The possibility to immediately detect and react to external interference or jamming signals is an advantage in the field of industrial wireless communications. If successfully applied, it can change radically the market for these solutions, increasing the customer's trust in wireless networks.

There is also provided a method implemented by the wireless network node for detecting an interfering signal in a wireless network communication system. The method comprises the steps of determining an energy pattern of expected received input signals based on a topology of said wireless network communication system and/or on data traffic patterns, receiving (e.g., by a detector arranged upstream of the receiver) an input signal from at least one antenna and determining an energy pattern of the input signal while delaying the input signal's arrival at a receiver configured to process the input signal, comparing by the detector the energy pattern of said input signal with said energy pattern of expected received input signals and emitting an alarm signal to at least said receiver while still delaying the input signal's arrival at the receiver, in the event that said receiver of the wireless network node is active and said input signal has an energy pattern different from said energy pattern of expected received input signals and/or in the event that said receiver is inactive and said input signal has an energy pattern similar or equal to said energy pattern of expected received input signals.

When the alarm signal reaches the receiver it may activate different actions that will prevent the jamming signal to reach the baseband of the receiver. This is an advantage over, e.g., the blacklisting mechanism that relies on interference-detection algorithms implemented in the baseband receiver, after the packets have been decoded. For instance, in case a jamming signal transmits with a very high power, the input of the analog-to-digital converter (ADC) at the receiver will be saturated and no useful signal will reach the baseband, thus preventing the blacklisting mechanism from working correctly.

Some examples of the actions performed by the method may be comprising the step of switching/change to a new channel by said receiver in the event that the receiver is active when said alarm signal is emitted. Following the change of channel, the emitting step of the method may comprise sending the alarm signal to a transmitter of the wireless network node and/or to a switch arranged to disconnect the at least one antenna from a receiving processing circuit, in order for the switch to be opened if the receiver is active. When the transmitter receives the alarm signal from the detector, the transmitter may send a message on a reserved channel to inform other network nodes wirelessly linked to the wireless network communication system of a detected interfering signal and to request a change of channel.

However, in the event the receiver is inactive, the emitting step may comprise sending an alarm signal to said switch in order for the switch to be closed. This involves closing the circuit and allowing the receiver to receive input signals from the at least one antenna.

Further, the method may comprise the step of delaying by a delay component configured to delay the input signal from the at least one antenna prior to arrival at the receiver.

Further, the method may comprise the step of changing a control system of said receiver to a safe mode when said switch is opened. The receiver has an underlying control system to handle the control messages received in the node and by turning the control sytem to a safe mode, the power will reduce as well as the performance of the network.

Furthermore, the method may be used in industrial control systems.

There is provided a detector for detecting an interfering signal in a wireless network communication system and configured to receive an input signal from at least one antenna, compare an energy pattern of said input signal with a determined energy pattern of expected received input signals provided by a receiver of a wireless network node, and send an alarm signal to at least said receiver in the event that said receiver is active and said input signal has an energy pattern different from said pattern of expected received input signals and/or in the event that said receiver is inactive and said input signal has an energy pattern similar or equal to said energy pattern of expected received input signals.

The use of a radio-based detector as claimed configured to recognize external interference is advantageous over using software mechanisms due to the practicality of using hardware. For example the circuitry of dedicated hardware can be optimized for performing the acts described above.

The advantage with this specific configuration of the node is that it is easy to verify whether the competitors are copying/applying the configuration or not. If, when opening and inspec-ting the node's circuitry, a detector, a delay and a switch is placed between the receiving antenna and the receiving processing circuit, then a copy of the wireless node is detected.

Further, the detector may be configured to send the alarm signal to a transmitter in the event the receiver is active. The alarm signal emitted by the detector of the wireless node may trigger the transmitter to send a message on a reserved channel to inform other network entities/nodes wirelessly linked to said wireless network communication system of a detected interfering signal and to request a change of channel.

BRIEF DESCRIPTION OF THE DRAWINGS

In the following, the invention will be described in further detail with references to the exemplary method and device in the drawings, on which:

FIG. 5 shows a flowchart of the method performed by an exemplary embodiment of the present disclosure; and FIG. 6 shows a flowchart of the method performed by another exemplary embodiment of the present disclosure.

DETAILED DESCRIPTION

Figure 1:
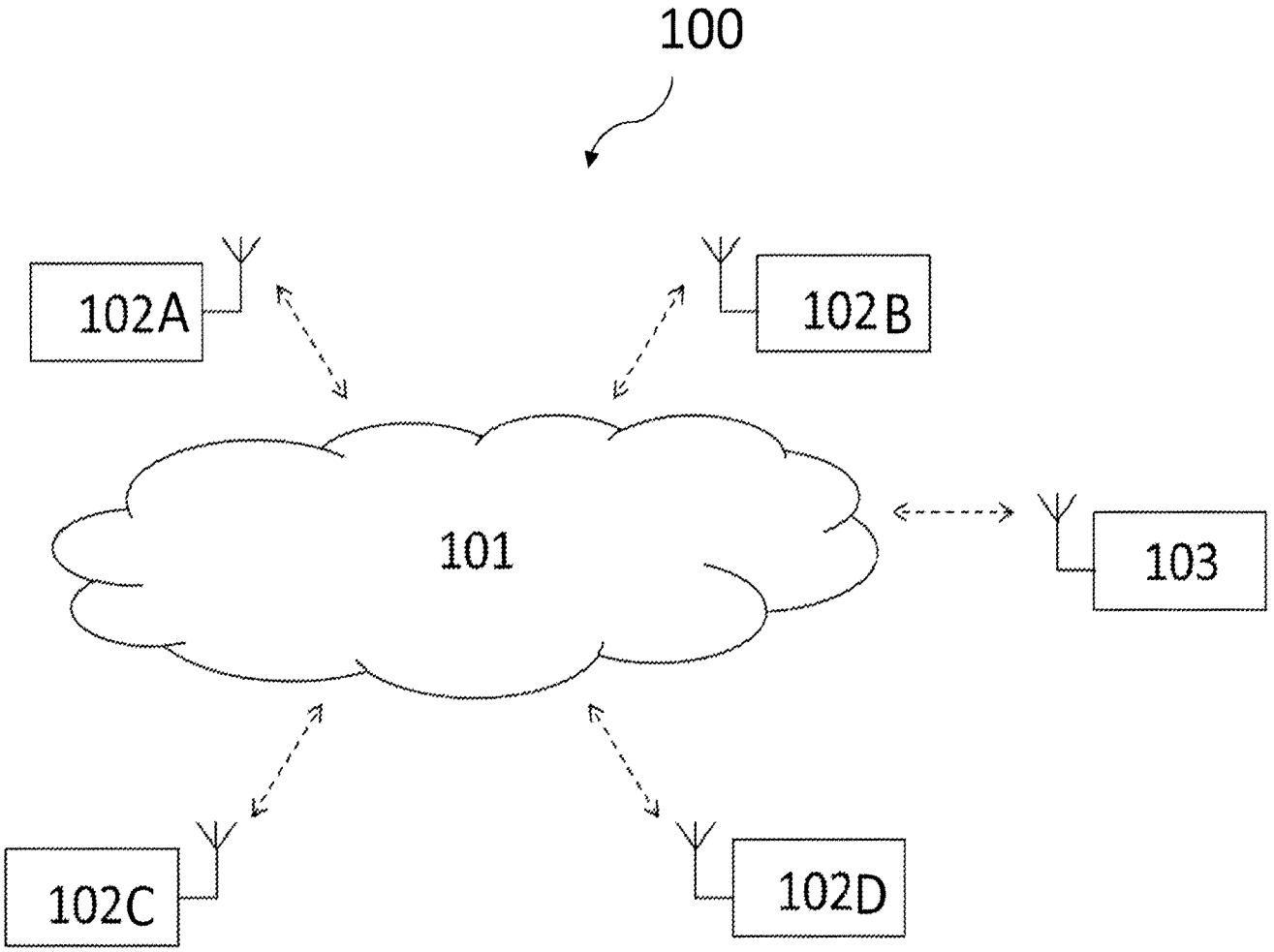
FIG. 1 shows a general view of a wireless network.

The present disclosure may be applied to a configuration similar to the one represented in FIG. 1. The FIG. 1 shows a wireless communication system 100 having a network manager 101 that communicates with several wireless entities 102, also called nodes. These nodes 102 A-D are equipped with at least one antenna, which is alternatively used for transmission and reception of the input signals. However, when more antennas are applied, the functionalities of the antennas may change. For instance, an antenna may be a receiving antenna and another may be a transmitting antenna or simply in the case that multiple antennas are applied, they may cooperate with each other to receive/transmit a more accurate information. The nodes are also equipped with an RF front-end that allows to communicate over the wireless network. The nodes may represent different components of a sub-station automation system, e.g., gateways, breakers, protections, exchanging control messages.

In industrial wireless networks, especially in a license-free wireless network, other nodes that do not belong to the wireless communication system may transmit in the same portion of the frequency spectrum and interfere the communication between the nodes and the network manager. These types of nodes 103 are called interferers and can be either non-malicious or malicious. In the first case, the interferer may be a node belonging to a separate wireless network operating in the same frequency band. In the second case, the interferer may be a jammer which purposely transmits on the same band of the targeted network with the aim of disturbing the reception of the nodes and impairing the proper functioning of the control algorithm. In both cases, the transmitting pattern of the interferer 103 differs from the communication schedule of the targeted network, thus becoming an unpredictable source of interference.

Figure 2:
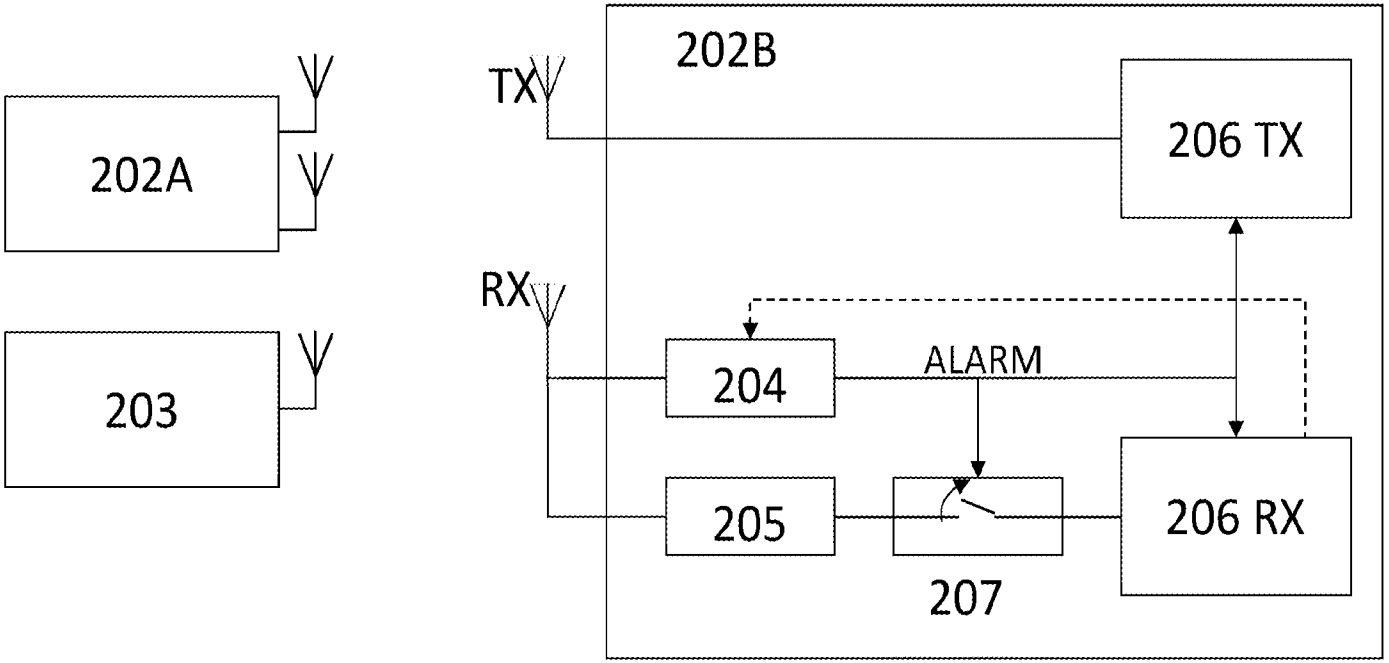
FIG. 2 shows a scheme of the wireless node in the wireless network according to an exemplary embodiment of the present disclosure.

An exemplary embodiment of the present invention is shown in FIG. 2. The figure shows two network entities or nodes 202A, 202B, and an interferer 203 in a wireless communication system. Optionally, the communication system is operated using time scheduling. The communication is managed by a central entity (not shown) and distributed among all the nodes 202A, 202B. In this way, each node knows exactly the transmitting patterns of all the other nodes in the network. The communication is a duplex communication between the network nodes and the central entity or controller. The optional time scheduling may relate to a channel access method which allows the nodes to share the same frequency channel by dividing the control message/signal into different time slots and it could be e.g. a time-division multiple access, TDMA. However, the wireless node 202B may use any time-scheduled communication system.

As shown in node 202B, each node comprises a transmitter 206 TX and a receiver 206 RX. The receiver 206 RX is operatively connected to a receiving antenna RX arranged to receive radio waves from other transmitting nodes, each transmitting via an antenna TX. However, each node may have several antennas to receive and transmit information in the communication system. Moreover, the receiver 206 RX comprises a radio-frequency (RF) circuit, a baseband processor to process the data and a storage to store it.

The node 202B is modified to overcome problems related to unpredictable interference in wireless networks, e.g. in power system control applications. The modification involves a new architecture of the node 202B. The new architecture comprises a detector 204. The new architecture may also comprise a delay component 205 and/or a switch 207. This detector 204, the delay component and the switch are added to a receiving part of the node 202B, between the receiving antenna RX and a receiver 206 RX. Thanks to this configuration, the detector receives the input signal from the at least one receiving antenna RX prior to the input signal reaches the receiver.

The detector is arranged to determine the energy pattern of the received input signal. This is achieved by taking the power of the input signal vs time. Accordingly, the particularities of a time-scheduling structure of the wireless communication system may be considered when determining the energy pattern of the signal.

Further, the baseband processor inside the receiver 206 RX is arranged to provide the detector 204 with another energy pattern shown as a dotted arrow in node 202B. This energy pattern is obtained by collecting information about input signals sent from the transmitting nodes and observed in the previous communication cycles by the receiver. The collected information may comprise data traffic patterns or power levels for each time slot belonging to the time scheduling structure of the system. The energy pattern may also be based on the topology of the wireless network communication system. The collected information is used for obtaining an estimation of the possible or expected received input signals coming from the transmitting nodes of the same wireless network. The obtained estimation is characteristically represented in an energy pattern. In other words, the energy pattern, which is provided by the receiver, represents the expected trend of power over time of the received input signals. The energy pattern is then sent to the detector 204. The detector 204 comprises a comparator (not shown) which compares the energy pattern of the received input signal with the energy pattern of the expected received input signals. If an interferer has interfered the input signal, a different pattern will be detected by the detector 204 deviating from the expected energy pattern.

The comparator compares and detects the differences between both energy patterns and if the patterns differ from each other, the detector 204 will emit an alarm signal to the receiver 206 RX. If the differences are significant, it may be easier for the comparator to compare and detect them so an alarm signal is emitted. However, the comparator is configured to react on less significant differences as well.

The wireless network node 202B may further comprise a switch 207 connected in serie with a delay component, which may be analogue. Both components are connected between the antenna RX and the receiver 206 RX and connected in parallel with the detector 204. As seen in the FIG. 2, the alarm signal ALARM is sent by the detector 204 to the switch 207 in order to open the electrical circuit of the node 202B preventing the jammed or interfered signal from an interferer 203 to reach the receiver 206 RX. The delay component 205 delays the input signal from the receiving antenna RX before it reaches the receiver 206 RX. This delay allows the detector 204 to have enough time to recognize a possible interfering pattern and to send the alarm signal. For the wireless node 202B to work properly, it needs to be both fast to ensure immediate reaction to interference and minimum delay in normal conditions and robust to cope with high radio-frequency power from potential jammers.

The receiver may also switch to a new channel when the switch opens the circuit as an action to prevent the jammed signal to further interfere the communication.

The alarm signal may also reach the transmitter 206 TX which in this case may send a data message through a reserved channel only for this purpose to other nodes in the network and if the receiver has changed the channel, it will request for a new channel so the communication is capable of flowing again between the nodes.

Figure 3:
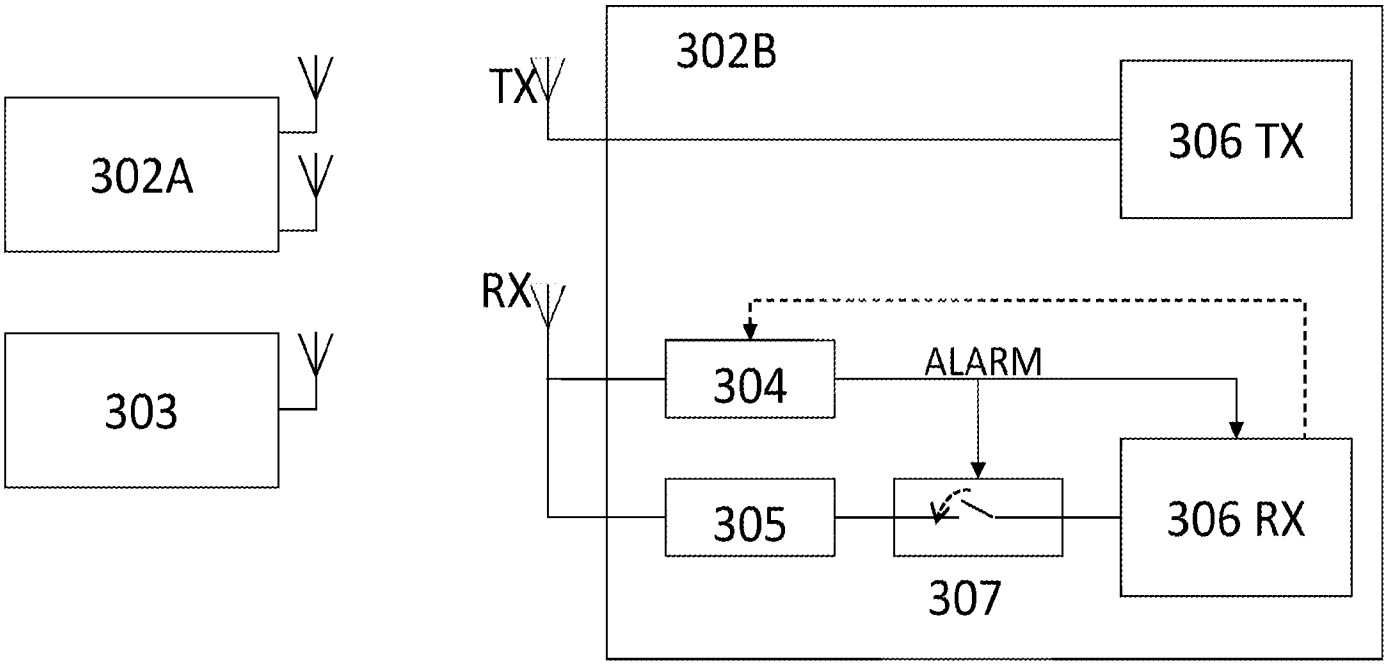
FIG. 3 shows a scheme of the wireless node in the wireless network according to another exemplary embodiment of the present disclosure.

Another exemplary embodiment of the node 302B of the present invention is shown in FIG. 3. This embodiment is different from the one in FIG. 2 in that in this case the receiver 306 RX is not receiving any input signals from the transmitting node 302A until the comparator in the detector 304 determines that the energy pattern of the received input signal and the energy pattern of the expected received input signals are aligned. This is happening when the interferer 303 is no longer around and the input signal can be safely received by the receiver 306 RX. In view of this, the detector emits an alarm signal both to the switch 307 and to the receiver 306 RX. In this case, there is no need to send the alarm signal to the detector 306 TX because no change of channel is made. Upon the alarm signal ALARM, the switch 307 closes the circuit so the receiver can start receiving the packets. As in the previous described exemplary embodiment, the delay component 305 still have the same function of delaying the input signals so the detector is allowed the time to detect the alignment of the patterns and emit the alarm signal to the receiver 306 RX.

Figure 4:
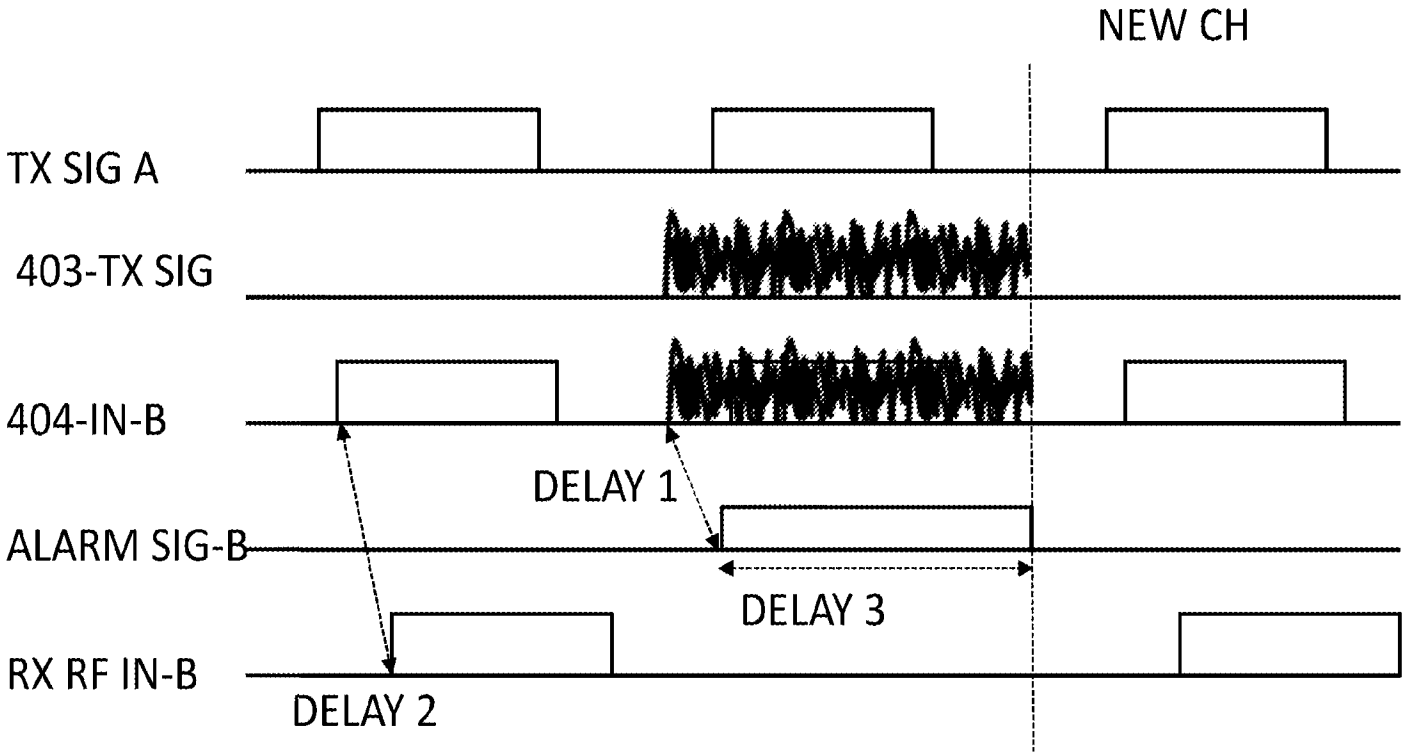
FIG. 4 represents signal patterns of two wireless entities/nodes during interference according to an exemplary embodiment of the wireless network node of the present disclosure.

In FIG. 4, signal patterns of wireless entities or nodes are represented during interference according to the exemplary embodiment of the nodes depicted in FIG. 2.

As shown in FIG. 4 and by referring to the embodiment of FIG. 2, the node 202A transmits a signal in a periodic pattern via a transmitter to the node 202B. The interferer 203, 403 starts transmitting at the same time and with the same frequency a jamming signal which is shown as 403 TX SIG. The detector at node 202B receives the signal sent from the node 202A via at least one antenna RX. However, the signal is affected by the jammed signal from the interferer 203, 403 as shown in 404 IN-B. Because this pattern differs from the energy pattern of expected received input signals provided by the baseband processor in the receiver 206 RX, the detector 204 determines to trigger an alarm signal to the receiver 206 RX shown as ALARM SIG-B. The amount of time needed by the detector to detect the interference and start the alarm signal is shown as DELAY 1. Once the alarm signal ALARM is emitted to the receiver 206 RX after the delay DELAY 1, the receiver needs time to process the alarm signal and react to it so different actions can be performed as remedy. This processing time is shown as DELAY 3.

In this example, the receiver 206 RX reacts to the detected interference by changing to a new channel NEW CH and also informing the transmitter 206 TX of the channel switch. Consequently, the transmitter 206 TX sends a message on a reserved channel to inform other nodes of the detected interference and request the transmitting node 202A for a channel switch. However, in order to avoid the detected jamming signal to reach the receiver 206 RX, a switch 207 and a delay component 205 are hereby used. The alarm signal triggers not only the receiver 206 RX but also the switch which opens up the circuit so the detected interfered signal cannot reach the receiver 206 RX and an artificially delay DELAY 2 is introduced by the delay component 205 as shown in RX RF IN-B. This delay DELAY 2 delays the input signal from the antenna RX allowing enough time to the detector for the recognition of a possible interfering pattern before the signal reaches the receiver 206 RX. The following data packet is then sent by the transmitting node 202A on the new indicated channel which is free from interference so the information can be successfully received.

The present disclosure is also provided as a method described in method steps in FIGS. 5 and 6. FIG. 5 depicts a flowchart of an example of the method according to the present disclosure.

The method described in FIG. 5 is implemented by a wireless network node 202B comprising a receiver 206 RX, a transmitter 206 TX and a detector 204. The baseband processor (not shown) inside the receiver 206 RX observes the data traffic pattern of previous communication cycles for the transmitting nodes belonging to the wireless system (which optionally includes time scheduling) and then determines at which time instants/slots these nodes will transmit radio signals. Based on this information and possibly further knowledge of the network topology, the expected received energy for each input signal shown in step S1A is computed and the expected received energy pattern, i.e. energy vs time received signal patterns, are determined as shown in step S2. The energy pattern is also determined in step S2 for the input signal received from the receiving antenna RX by measuring the received energy vs time. It may be possible that the wireless network nodes has several receiving antennas that cooperate with each other, but at least one is needed to receive the input signal from the node 202B.

As previously explained, the configuration of the wireless network node 202B is adapted so the detector receives the input signal prior to the receiver so in the event of an interferer shows up, the jammed signal from the interferer 203 is dealt with before it arrives to the receiver 206 RX or baseband processor.

The detector 204 uses a comparator to compare the energy pattern of the received input signal with the expected energy pattern as shown in step S3. When an interferer 203 is transmitting a jammed signal in the same frequency as the rest of the nodes, the received input signal is then interfered with the jammed signal and the energy pattern of the input signal will differ from the expected one. If this happens, the comparator will detect the difference in step S4 and an alarm signal will be emitted as shown in step S5. On the other hand, if the energy patterns are not different as shown in S4, the process is repeated for each new input signal received from the other nodes in the wireless network.

In the event that the alarm signal is triggered by detector, there are different actions to be implemented in order to avoid the jammed signal intruding the transmission. An example of these actions are shown in steps S6-S7 of FIG. 6. In this example, the alarm signal is used for disconnecting the receiver by opening the switch upon the detection of an interfering pattern. The alarm signal may also be forwarded to both the transmitter and receiver in the actual node in order to take further actions. These actions include for instance sending a message on an already reserved channel to inform other nodes of the detected interference and request changing of channel. Other actions may include switching the underlying control system to a safe mode that could tolerate potential losses of packets and reduce networking performance. These are only examples of actions that can be performed but the present disclosure is not limited to these actions in reaction to a detected interference.

The method may also be used in an interfered environment where it is important to detect when the energy pattern of the received input signal and the energy pattern of the expected received input signals are aligned or similar or equal. In this case, the receiver is not active and can only be activated once the switch is closed. In step S5, the energy patterns are compared and in the event that they are different, the alarm signal is not emitted, shown as a "NO" in a dashed box, so the energy patterns will once again be determined and compared. However if they are not different, i.e. aligned/similar/equal, this will mean that the interferer is no longer transmitting so an alarm signal is then emitted to the receiver to activate it, shown as "YES" in a dashed box. The alarm signal is also emitted to the switch for closing it so that the receiver is capable of being activated and to receive the input signals transmitted from other nodes via the antenna.

Whilst the invention has been described with respect to illustrative embodiments thereof, it will be understood that various changes may be made in the node/entity and means herein described without departing from the scope and the teaching of the invention. Accordingly, the described embodiments are to be considered merely exemplary and the invention or disclosure is not to be limited except as specified in the attached claims.

The invention claimed is:

1. A method implemented by a wireless network node for detecting an interfering signal in a wireless network communication system, the method comprising:

determining an energy pattern of expected received input signals based on a topology of said wireless network communication system and/or on data traffic patterns, receiving an input signal from at least one antenna, delaying the input signal's arrival at a receiver configured to process the input signal while determining an energy pattern of said input signal and comparing said energy pattern of said input signal with said energy pattern of expected received input signals, emitting an alarm signal to at least said receiver while preventing the input signal's arrival at the receiver, in the event that an alarm condition is satisfied, wherein the alarm condition is that said receiver of the wireless network node is active and said input signal has an energy pattern different from said energy pattern of expected received input signals and/or that said receiver is inactive and said input signal has an energy pattern similar or equal to said energy pattern of expected received input signals, and allowing the input signal to arrive at said receiver in the event that the alarm condition is not satisfied.

2. The method according to claim 1, wherein the method further comprises switching to a new channel by said receiver in the event that the receiver is active when said alarm signal is received.

3. The method according to claim 2, wherein the emitting further comprises sending said alarm signal to a transmitter of the wireless network node.

4. The method according to claim 3, wherein said transmitter sends a message on a reserved channel to inform other network nodes wirelessly linked to said wireless network communication system of a detected interfering signal and to request a change of channel.

5. The method according to claim 1, wherein the method is used in an industrial control system.

6. A method implemented by a wireless network node for detecting an interfering signal in a wireless network communication system, the method comprising:

determining an energy pattern of expected received input signals based on a topology of said wireless network communication system and/or on data traffic patterns, receiving an input signal from at least one antenna and determining an energy pattern of said input signal while delaying the input signal's arrival at a receiver configured to process the input signal, comparing said energy pattern of said input signal with said energy pattern of expected received input signals, and emitting an alarm signal to at least said receiver while still delaying the input signal's arrival at the receiver, in the event that said receiver of the wireless network node is active and said input signal has an energy pattern different from said energy pattern of expected received input signals and/or in the event that said receiver is inactive and said input signal has an energy pattern similar or equal to said energy pattern of expected received input signals, wherein the emitting further comprises sending said alarm signal to a switch arranged to disconnect the at least one antenna from a receiving processing circuit, in order for the switch to be opened if said receiver is active and for the switch to be closed if said receiver is inactive.

7. The method according to claim 6, wherein the method further comprises changing an underlying control system of said receiver to a safe mode when said switch is opened.

8. A wireless network node for detecting an interfering signal in a wireless network communication system, the wireless network node comprising:

a transmitter configured to transmit information to other nodes in said wireless network communication system, a receiver configured to receive and process information from other nodes in said wireless network communication system, and determine an energy pattern of expected received input signals based on a topology of said wireless network communication system and/or based on data traffic patterns, a detector configured to receive an input signal from at least one antenna, and receive and compare said energy pattern of expected received input signals with an energy pattern of said input signal, and a delay component configured to delay said input signal from said at least one antenna prior to arrival at said receiver while said detector is comparing said energy pattern of expected received input signals with said energy pattern of said input signal, wherein said detector is further configured to emit an alarm signal to at least said receiver while preventing said input signal's arrival at the receiver, in the event that an alarm condition is satisfied, wherein the alarm condition is that said receiver is active and said input signal has an energy pattern different from said pattern of expected received input signals and/or that said receiver is inactive and said input signal has an energy pattern similar or equal to said energy pattern of expected received input signals, and allow the input signal to arrive at said receiver in the event that the alarm condition is not satisfied.

9. The wireless network node according to claim 8, wherein said receiver, when active, is configured to switch to a new channel when said alarm signal is received.

10. The wireless network node according to claim 9, wherein said transmitter is configured to send a message on a reserved channel to inform other network nodes wirelessly linked to said wireless network communication system of a detected interfering signal and to request a change of channel.

11. The wireless network node according to claim 10, wherein said detector is further configured to send said alarm signal to said transmitter.

12. A wireless network node for detecting an interfering signal in a wireless network communication system, the wireless network node comprising:

a transmitter configured to transmit information to other nodes in said wireless network communication system, a receiver configured to receive and process information from other nodes in said wireless network communication system, a detector configured to receive an input signal from at least one antenna, and a delay component configured to delay said input signal from said at least one antenna prior to arrival at said receiver, wherein said receiver is further configured to determine an energy pattern of expected received input signals based on topology of said wireless network communication system and/or based on data traffic patterns, wherein said detector is further configured to receive and compare said energy pattern of expected received input signals with an energy pattern of said input signal and to emit an alarm signal to at least said receiver while the delay component is delaying said input signal's arrival at the receiver, in the event that said receiver is active and said input signal has an energy pattern different from said pattern of expected received input signals and/or in the event that said receiver is inactive and said input signal has an energy pattern similar or equal to said energy pattern of expected received input signals, and wherein said node further comprises a switch arranged to disconnect the at least one antenna from a receiving processing circuit, in order, wherein the switch is configured to be opened if said receiver is active and to be closed if said receiver is inactive when receiving said alarm signal from said detector.

13. The wireless network node according to claim 12, wherein said receiver is further configured to change its underlying control system to a safe mode after said switch is opened.

14. A detector for detecting an interfering signal in a wireless network communication system, the detector configured to:

receive an input signal from at least one antenna, compare an energy pattern of said input signal with a determined energy pattern of expected received input signals provided by a receiver of a wireless network node, and emit an alarm signal to at least said receiver in the event that said receiver is active and said input signal has an energy pattern different from said pattern of expected received input signals and in the event that said receiver is inactive and said input signal has an energy pattern similar to said energy pattern of expected received input signals.

15. The detector according to claim 14, wherein said detector is further configured to send said alarm signal to a transmitter in the event said receiver is active.

16. The detector according to claim 15, wherein the alarm signal causes said transmitter to send a message on a reserved channel to inform other network nodes, wirelessly linked to said wireless network communication system, of a detected interfering signal and to request a change of channel.

* * * * *